US006779662B2

(12) United States Patent
Dorsey

(10) Patent No.: US 6,779,662 B2
(45) Date of Patent: Aug. 24, 2004

(54) MOISTURE RESISTANT COIL PACKAGE

(75) Inventor: Joseph Alan Dorsey, Knoxville, TN (US)

(73) Assignee: Polypac, Inc., Maynardville, TN (US)

( * ) Notice: Subject to any disclaimer, the term of this patent is extended or adjusted under 35 U.S.C. 154(b) by 243 days.

(21) Appl. No.: 10/198,411

(22) Filed: Jul. 18, 2002

(65) Prior Publication Data

US 2004/0011686 A1 Jan. 22, 2004

(51) Int. Cl.[7] ..... B65D 85/66

(52) U.S. Cl. ..... 206/397; 206/408; 206/410; 206/523

(58) Field of Search ..... 206/303, 389, 206/397, 408, 410, 484, 484.2, 521, 523, 524; 220/4.21, 4.24, 8; 242/170, 171, 129, 137

(56) References Cited

U.S. PATENT DOCUMENTS 1,940,088 A * 12/1933 Harrison ..... 206/408
2,335,766 A * 11/1943 Kinloch ..... 206/408
3,685,644 A * 8/1972 Cothran et al. ..... 206/408
4,793,485 A * 12/1988 Bertolotti ..... 206/397
5,105,943 A 4/1992 Lesko et al.
5,215,192 A * 6/1993 Ram et al. ..... 206/389
5,819,934 A 10/1998 Cooper
6,237,768 B1 5/2001 Cipriani
6,286,684 B1 * 9/2001 Brooks et al. ..... 206/523

* cited by examiner

*Primary Examiner*—Luan K. Bui
(74) *Attorney, Agent, or Firm*—Pitts & Brittian, PC

(57) ABSTRACT

A package for a metal coil to prevent condensation of moisture on the metal coil comprises a lower sleeve and an upper sleeve. The lower sleeve comprises a cushion, a moisture barrier secured to the cushion, and a generally cylindrical insulating wrapper secured to the moisture barrier. The upper sleeve comprises a moisture barrier and a generally cylindrical insulating wrapper secured to the moisture barrier of the upper sleeve. The lower sleeve and the upper sleeve are sized to matingly engage one another to encase the metal coil.

11 Claims, 2 Drawing Sheets

MOISTURE RESISTANT COIL PACKAGE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a package for metal coils.

More particularly, this invention pertains to a moisture resistant package with thermal insulating features for metal coils.

2. Description of the Related Art

When metal coils, such as sheet aluminum or steel, for example, are shipped via truck or train, they are frequently covered with a protective cover to prevent damage, especially from weather such as snow or rain. A single coil of aluminum, for example can have a value in excess of $20,000.00. Moisture from rain snow or sleet can cause corrosion of the metal, a substantial loss of value for such a coil. However, there are other ways in which moisture can damage a coil, even inside protective cover.

In particular, as a vehicle moves through rapidly changing climate conditions, as frequently happens during travel through mountainous regions, the metal coil maintains a temperature that varies from the ambient temperature. As a result of the temperature variation, particularly when the temperature of the metal is less than the ambient temperature, moisture condenses on the exposed metal surface or on the inside of the protective cover. Just like rain, condensed moisture can damage the coil of metal. Furthermore, the damage is not just limited to the outer cylindrical surface, but also to the edges of the entire coil.

It is therefore an object of the present invention to provide an insulating, protective cover for metal coils.

It is also an object to provide an insulating, protective cover for metal coils that is resistant to tears if the coil shifts upon the surface of the cover.

Further objects and advantages will be apparent to those skilled in the art.

BRIEF SUMMARY OF THE INVENTION

According to one embodiment of the present invention, an insulating protective cover is provided for a coil of metal sheeting. The protective cover includes a generally cylindrical lower sleeve adapted to receive the cylindrical coil and a generally cylindrical upper sleeve adapted to matingly engage the lower sleeve.

The lower sleeve includes a bottom cushion to which is secured a lower moisture barrier. A generally cylindrical, insulating lower wrapper surrounds the coil, having an open end and an engaged end. The engaged end of the inner wrapper is secured to the lower moisture barrier. A secondary lower moisture barrier is secured within the wrapper adjacent to the engaged end of the lower wrapper and the lower moisture barrier.

The upper sleeve includes an upper moisture barrier. A generally cylindrical, insulating upper wrapper has an open end and an engaged end. The engaged end of the upper wrapper is secured to the upper moisture barrier.

When the metal coil is deposited within the lower sleeve, the upper sleeve is matingly engaged over the lower sleeve, encasing the metal coil within an insulating protective cover.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
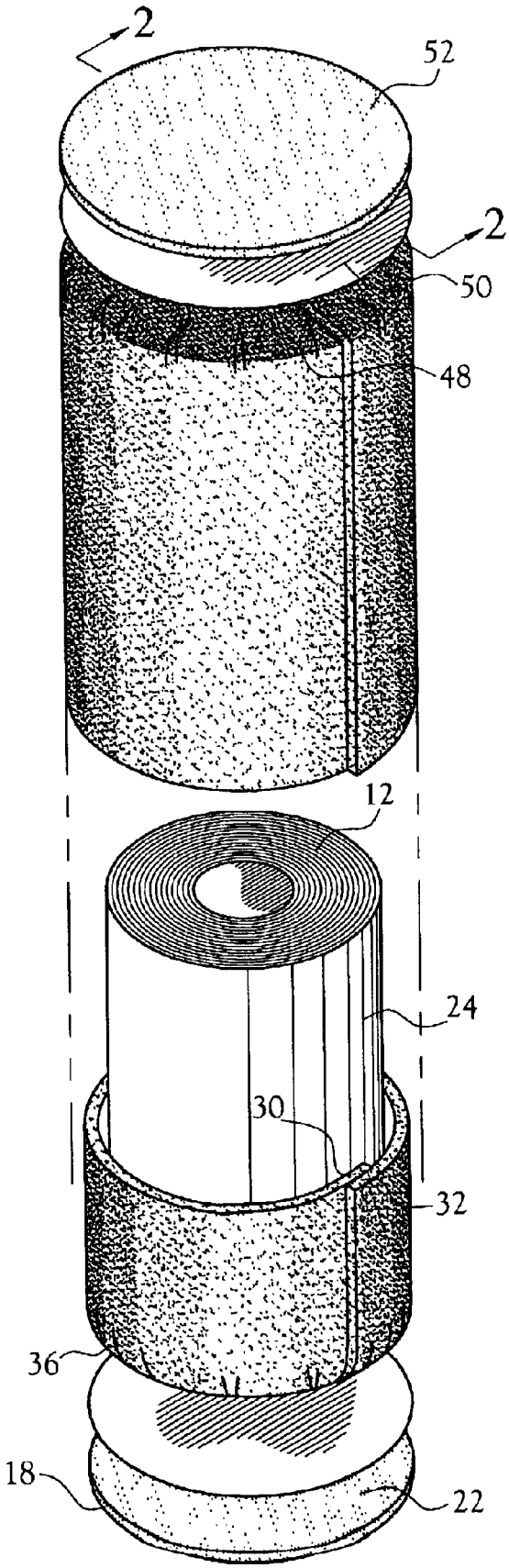
FIG. 1 is an exploded perspective view of an insulating, protective cover embodying various of the features of the present invention.
Figure 2:
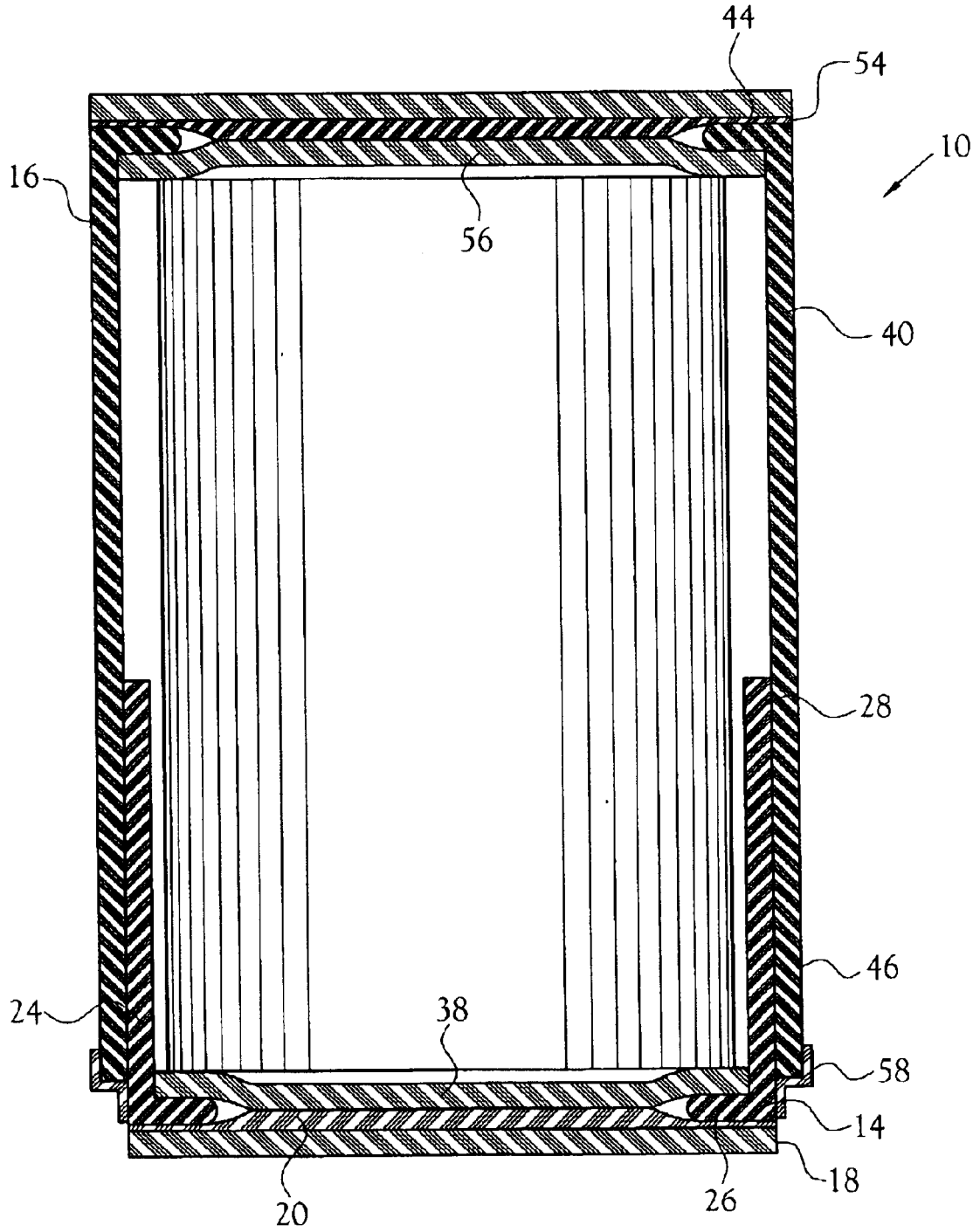
FIG. 2 is a perspective view, partially in cutaway, of an insulating, protective cover embodying various of the features of the present invention.

Referring to the drawings, wherein like numbers represent like parts, there is disclosed an insulating protective cover 10 for a coil 12 of metal. The insulating protective cover 10 includes a lower sleeve 14, adapted to matingly receive the coil 12 and partially surround the coil 12, and an upper sleeve 16 adapted to matingly receive the lower sleeve 14 to complete the enclosure of the coil 12.

The lower sleeve 14 includes a bottom cushion 18 comprising shoddy, a fibrous material obtained by shredding unfelted rags or carpet waste, for example, in the depicted embodiment. The shoddy bottom cushion 18 is approximately ⅜ inch thick and is cut in a circular shape having a diameter approximating the diameter of the coil 12.

A lower moisture barrier 20 is secured to the top surface 22 of the cushion 18. In the depicted embodiment, the moisture barrier comprises a sheet of polypropylene or polyethylene film about 2 mils in thickness, and is cut in a circular shape having a diameter approximating the diameter of the coil 12. Preferably, the lower barrier 20 is secured to the cushion 18 with a hot melt glue, well known to those skilled in the art, and in a pattern that is generally circular and adjacent to the periphery of the cushion 18 to leave the central area of the lower barrier 20 unsecured to the cushion 18.

A lower wrapper 24, comprising an elongated sheet of ⅛ inch polypropylene foam or polyethylene foam laminated to 9×6 woven polyethylene or woven polypropylene, includes a secured edge section 26, an opposed unsecured edge section 28, a first end section 30 and an opposed second end section 32. The lower wrapper 24 is secured to the lower barrier 20. The secured edge section 26 is folded, crimped to form a cylindrical shape and attached, as with hot melt glue, well known to those skilled in the art, around the peripheral edge 36 of the lower barrier 20. The first end section 30 overlaps the second end section 32. The first end section 30 is secured with a hot melt glue, well known to those skilled in the art, to the second end section 32 in a continuous line from the barrier 20 to approximately the height of the lower sleeve 14. In the depicted embodiment, the lower sleeve is approximately 22 inches in height.

A secondary upper moisture barrier 38, circular in shape and comprising 2-ounce non-woven polypropylene with 1.5-mil polypropylene coating on each side, is secured within the lower wrapper 24 adjacent to the lower moisture barrier 20. A circular pattern of an adhesive, such as hot melt glue, well known to those skilled in the art, secures the secondary lower moisture barrier 38 to the secured edge section 26 of the sheet 24. The coil 12 rests upon the secondary moisture barrier, partially enclosed by the lower wrapper 24.

An upper wrapper 40 comprising an elongated sheet of ⅛ inch polypropylene foam or polyethylene foam laminated to 9×6 woven polyethylene or woven polypropylene, includes a secured edge section 44, an opposed unsecured edge section 46, a first end section 48 and an opposed second end section 50. The secured edge section 44 is folded, crimped to form a cylindrical shape and attached, as with hot melt glue, well known to those skilled in the art, around the peripheral edge 54 of an upper moisture barrier 52. In the depicted embodiment, the upper moisture barrier 52 comprises wax coated 200 lb. C-flute corrugated paperboard. Wax coatings are well known to those skilled in the art. Suitable wax coatings are available from Michelman, Inc. The first end section 48 overlaps the second end section 50. The first end section 48 is secured with a hot melt glue, well known to those skilled in the art, to the second end section 50 in a continuous line from the barrier 48 to the unsecured edge section 46. In the depicted embodiment, the upper wrapper is approximately 46 inches in height.

The upper moisture barrier 52 is approximately ⅛ inch thick and is circular in shape, having a diameter approximating the diameter of the coil 12.

A top secondary upper moisture barrier 56, circular in shape and comprising 2-ounce non-woven polypropylene with 1.5-mil polypropylene coating on each side, is secured within the lower wrapper 24 adjacent to the upper moisture barrier 20.

In use, the lower sleeve 14 is assembled as described hereinabove and a metal coil 12 is matingly inserted into the lower sleeve 14. Thereafter, the upper sleeve 16 is assembled as described hereinabove and lowered over the metal coil 12 and the lower sleeve 14 to completely enclose the metal coil 12. The joint between the lower sleeve 14 and the upper sleeve 16 is then peripherally sealed, as with an adhesive or tape 58. The metal coil 12 is thus contained within a fully sealed, thermally insulated, moisture-proof package.

From the foregoing description, it will be recognized by those skilled in the art that a moisture resistant package has been provided for a metal coil. Sudden changes in temperature are minimized by the thermal insulating properties of the package. Moreover, ambient moisture is prevented from condensing on the metal coil by the moisture impermeable materials of the package. It has also been found that securement of the moisture barrier to the bottom cushion in a circular pattern about the respective peripheral edges prevents damage to the lower moisture barrier in the event of shifting of the metal coil 12.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A package for a metal coil, said package comprising:

a lower sleeve and an upper sleeve, said lower sleeve comprising a cushion, a lower moisture barrier secured to said cushion, and a generally cylindrical insulating lower wrapper secured to said moisture barrier, and said upper sleeve comprising an upper moisture barrier and a generally cylindrical insulating upper wrapper secured to said upper moisture barrier, said lower sleeve and said upper sleeve being sized to matingly engage one another to encase said metal coil.

2. The package of claim 1 wherein said cushion comprises shoddy.

3. The package of claim 1 wherein said lower wrapper comprises polyethylene foam or polypropylene foam.

4. The package of claim 3 wherein said lower wrapper further comprises woven polypropylene or woven polyethylene laminated to said foam.

5. The package of claim 1 wherein said upper wrapper comprises polyethylene foam or polypropylene foam.

6. The package of claim 5 wherein said upper wrapper further comprises woven polypropylene or woven polyethylene laminated to said foam.

7. The package of claim 1 wherein said lower moisture barrier or said upper moisture barrier comprises non-woven polypropylene coated with polypropylene.

8. The package of claim 1 wherein said cushion is secured to said lower moisture barrier adjacent to the peripheral edge of said cushion.

9. The package of claim 1 wherein said upper moisture comprises a wax coated paperboard.

10. The package of claim 1 wherein said lower sleeve is peripherally sealed to said upper sleeve.

11. A package for a metal coil, said package comprising:

a lower sleeve and an upper sleeve, said lower sleeve comprising a cushion, a moisture barrier secured to said cushion about the peripheral edge of said cushion, a generally cylindrical thermal insulating wrapper secured to said moisture barrier, a secondary moisture barrier located within said lower sleeve adjacent to said moisture barrier, said upper sleeve comprising a moisture barrier, a generally cylindrical thermal insulating wrapper secured to said moisture barrier of said upper sleeve, a secondary moisture barrier located within said upper sleeve adjacent to said moisture barrier of said upper sleeve, and said lower sleeve and said upper sleeve being sized to matingly engage one another to encase said metal coil.

* * * * *